US006733945B2

(12) United States Patent
Hirota et al.

(10) Patent No.: US 6,733,945 B2
(45) Date of Patent: May 11, 2004

(54) TONER AND ELECTROPHOTOGRAPHIC METHOD

(75) Inventors: Noriaki Hirota, Suita (JP); Yasuhito Yuasa, Hirakata (JP); Hideki Tatematsu, Neyagawa (JP); Masahisa Maeda, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/435,922

(22) Filed: May 12, 2003

(65) Prior Publication Data

US 2003/0207192 A1 Nov. 6, 2003

Related U.S. Application Data

(62) Division of application No. 09/460,654, filed on Dec. 14, 1999, now Pat. No. 6,593,051.

(30) Foreign Application Priority Data

Dec. 17, 1998 (JP) ..... 10-358967

(51) Int. Cl.[7] ..... G03G 13/16
(52) U.S. Cl. ..... 430/125; 430/126; 430/45
(58) Field of Search ..... 430/45, 175, 176, 430/111.4

(56) References Cited

U.S. PATENT DOCUMENTS 5,072,244 A 12/1991 Aoki et al.
5,362,593 A * 11/1994 Inoue et al. ..... 430/108.21
5,753,399 A * 5/1998 Hayase et al. ..... 430/109.3
5,849,453 A * 12/1998 Mikuriya et al. ..... 430/125

FOREIGN PATENT DOCUMENTS

| | | |
|---|---|---|
| JP | 1-252982 | 10/1989 |
| JP | 2-190868 | 7/1990 |
| JP | 2-212867 | 8/1990 |
| JP | 2-282757 | 11/1990 |
| JP | 5-100477 | 4/1993 |
| JP | 6-59502 | 3/1994 |
| JP | 7-77838 | 3/1995 |
| JP | 9-304956 | 11/1997 |

OTHER PUBLICATIONS

Borsenberger, Paul et al. Organic Photoreceptors for Imaging Systems. New York: Marcel–Dekker, Inc. (1993) pp. 6–17.*

Gotoh, Keishi et al. Powder Technology Handbook. New York: Marcel–Dekker, Inc. (1997) pp. 3–14.

* cited by examiner

*Primary Examiner*—Christopher Rodee
(74) *Attorney, Agent, or Firm*—Merchant & Gould P.C.

(57) ABSTRACT

Toner of the present invention at least includes binder resin, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and the toner contains 5 to 50% by number of toner particles with a size of $2\times10^{-6}$ to $5\times10^{-6}$ m in size distribution of the toner.

21 Claims, 3 Drawing Sheets

TONER AND ELECTROPHOTOGRAPHIC METHOD

This application is a divisional of application Ser. No. 09/460,654, filed Dec. 14, 1999, now U.S. Pat. No. 6,593,051 which application(s) are incorporated herein by reference.

BACKGROUND OF THE INVENTION

1. Field of the Invention

The present invention relates to toner for use in an image forming apparatus such as a copier, a printer, and a facsimile, and an electrophotographic method.

2. Description of the Related Art

In electrophotographic copiers, printers, and the like, printing is performed by the following process. First, a photoreceptor is charged for forming an image. As a method for charging a photoreceptor, a corona electrical charger conventionally has been used. Recently, uniformly charging the surface of a photoreceptor by a contact type charging method has been put into practical use for the purpose of reducing the generation of ozone. According to the contact type charging method, a conductive roller is directly pressed onto a photoreceptor. In the case of a copier, after a photoreceptor is charged, an original for copying is irradiated with light. Then, the photoreceptor is irradiated with light reflected from the original through a lens system. In the case of a printer, an image signal is transmitted to a light-emitting diode, a laser diode, or the like as an exposure light source, and a latent image is formed on a photoreceptor by ON-OFF control of light. When a latent image (level of a surface potential) is formed on the photoreceptor, the latent image is developed with toner (diameter: about 5 $\mu$m to about 15 $\mu$m), which is previously charged coloring powder. Toner adheres to the surface of the photoreceptor in accordance with the level of a surface potential thereof, and thereafter is electrically transferred to a copying sheet. More specifically, toner is previously charged positively or negatively, and the back side of the copying sheet is charged with a polarity opposite to that of the toner, whereby the toner is attracted to the copying sheet. Hitherto, a corona electrical charger has been widely used for providing charge to the copying sheet in the same way as in charging a photoreceptor. However, in order to reduce generation of ozone, recently, a transfer apparatus using a conductive roller has been put into practical use. During transfer, all the toner on a photoreceptor is not transferred to a copying sheet. The toner partially remains on the photoreceptor. The remaining toner is scraped off by a cleaning blade or the like in a cleaning section to become waste toner. Conventionally, according to electrophotography, waste toner has been discarded without being recycled. Careless discarding should be avoided from the viewpoint of environmental protection. Recycling of waste toner poses a significant problem.

In a color copier, a photoreceptor is charged by a corona electrical charger. Thereafter, a latent image of each color is provided to the photoreceptor as a light signal, whereby an electrostatic latent image of each color is formed thereon. Then, the electrostatic latent image is developed with the first color (e.g., yellow toner) so as to become visible.

Thereafter, a transfer material charged with a polarity opposite to that of the yellow toner is brought into contact with the photoreceptor, whereby the yellow toner image formed on the photoreceptor is transferred to the transfer material. The toner remaining on the photoreceptor after transfer is cleaned, and the photoreceptor is discharged. Thus, development and transfer of the first color toner are completed.

Thereafter, the same process as that of yellow toner is repeated with respect to toner of magenta, cyan, and the like, and toner images of the respective colors are overlapped on the transfer material to form a color image. These overlapped toner images are transferred and fixed to a sheet charged with a polarity opposite to that of the toner images, whereby copying is completed.

A method for forming a color image generally includes a transfer drum method and a continuous overlapping method. According to the transfer drum method, a toner image of each color is successively formed on a single photoreceptor. Then, a transfer material wound around a transfer drum is rotated so as to repeatedly face the photoreceptor. A toner image of each color which is successively formed is transferred to the photoreceptor so as to overlap each other. According to the continuous overlapping method, a plurality of image forming sections is arranged. Then, each image forming section is passed through a transfer material transported by a belt. Thus, a toner image of each color is successively transferred to the transfer material in such a manner that color images overlap each other.

As an example using the above-mentioned transfer drum method, Japanese Laid-open Publication No. 1-252982 discloses a color image forming apparatus. FIG. 3 is a schematic view of an entire structure of the conventional example. Hereinafter, the structure and operation thereof will be described briefly.

In FIG. 3, reference numeral 501 denotes a photoreceptor. A charger 502, a developing section 503, a transfer drum 504, and a cleaner 505 are provided so as to face the photoreceptor 501. The developing section 503 includes a Y developing unit 506 for forming a yellow toner image, an M developing unit 507 for forming a magenta toner image, a C developing unit 508 for forming a cyan toner image, and a Bk developing unit 509 for forming a black toner image. All the developing units are rotated in such a manner that each developing unit successively faces the photoreceptor 501. Thus, each developing unit becomes ready for development. During operation, the transfer drum 512 and the photoreceptor 501 are rotated at a constant speed in respective arrow directions while facing each other. Reference numeral 518 denotes a toner hopper for supplying toner to a developing unit.

When an image forming operation is started, the photoreceptor 501 is rotated in the arrow direction, and the surface thereof is uniformly charged by the charger 502. Thereafter, the surface of the photoreceptor 501 is irradiated with a laser beam 510 which has been modulated with a signal for forming an image of the first color (yellow), and a latent image is formed on the surface of the photoreceptor 501. Then, the latent image is first developed by the Y developing unit 506, which faces the photoreceptor 501, to form a yellow toner image. By the time when the yellow toner image formed on the photoreceptor 501 moves to a position facing the transfer drum 504, an end of a transfer material (i.e., sheet transported from a sheet supply section 511) has been trapped by a hook 512 and wound around an outer periphery of the transfer drum 504. Thus, timing is provided in such a manner that the yellow toner image on the photoreceptor 501 faces a predetermined position of the sheet.

After the yellow toner image on the photoreceptor 501 is transferred to the sheet by a transfer charger 513, the surface of the photoreceptor 501 is cleaned by the cleaner 505, so that the surface is ready to receive a subsequent color image. Then, toner images of magenta, cyan, and black are similarly formed. At this time, the developing section 503 allows each developing unit used in accordance with color to face the photoreceptor 501, whereby each developing unit becomes ready for development. The transfer drum 504 has a size sufficient for allowing the longest sheet to wind around it and allowing developing units to be exchanged between images of respective colors.

The laser beam 510 for forming an image of each color is radiated in such a manner that a toner image of each color on the photoreceptor 501 faces a toner image which has been transferred to the sheet on the transfer drum 504 with their positions matched with each other during rotation. In this manner, toner images of four colors are overlapped and transferred to the sheet on the transfer drum 504, whereby a color image is formed on the sheet. After the toner images of all the colors are transferred, the sheet is peeled off from the transfer drum 504 by a peeling hook 514. Then, the sheet is passed through a transportation section 515 to have a toner image fixed thereon by a fixing unit 516, and output from the apparatus.

On the other hand, Japanese Laid-open Publication No. 1-250970 discloses a color image forming apparatus using a continuous transfer method. In this conventional example, for the purpose of forming images of four colors, four image forming stations each including a photoreceptor, a light-scanning unit, etc. are arranged, and a sheet transported by a belt is passed through a lower portion of each photoreceptor, whereby color toner images are overlapped.

Still furthermore, Japanese Laid-open Publication No. 2-212867 discloses another method for forming a color image by overlapping toner images of different colors on a transfer material. According to this method, a toner image of each color successively formed on a photoreceptor is first overlapped on an intermediate transfer material, and the toner images on the intermediate transfer material are transferred collectively to a transfer sheet.

As a method for permanently fixing transferred toner onto a copying sheet, a heat roll method, a pressure roll method, a flash fixing method, a method using an agent, and the like are known. Among them, the heat roll method is generally used from the viewpoint of energy efficiency, safety, and printing quality. According to this method, toner is melted on a heat roll and fixed onto a sheet.

In the case of performing the above-mentioned color printing, it is becoming necessary to satisfy characteristics required by color itself from the viewpoint of a fixing property. A color image includes several overlapped toner layers. Therefore, from the viewpoint of coloring, color reproducibility or glossiness, and transparency for an overhead projector (OHP), it is required to melt toner completely so that the surface thereof becomes flat. However, if excessively melted, toner adheres to the surface of a heat roll and is transferred to a transfer material such as a sheet transported thereafter. So-called hot offset occurs. In order to prevent hot offset, a heat roll is covered with a material such as silicone rubber and fluorocarbon resin having a satisfactory release property with respect to melted toner. Alternatively, a heat roll is coated with liquid having a satisfactory release property, such as silicone oil. Alternatively, a release component such as low molecular-weight polyethylene and low molecular-weight polypropylene is contained in the toner. The downside of these methods is that a mechanism of oil coating is complicated and an apparatus cannot be minimized. Furthermore, it is required to supply oil every predetermined period, and oil adheres to the surface of a transfer material such as a sheet. Therefore, it is required to minimize the consumption amount of oil. Furthermore, in the case where dispersibility of a release component contained in toner is poor, phenomena such as toner-filming and toner-spent occur. More specifically, this decreases toner flowability, which adversely affects charge characteristics, and furthermore, the toner adheres to a photoreceptor, a toner holder, carrier, and the like to contaminate them.

As is well-known, toner for electrostatic charge development used in the above-mentioned developing methods generally contains internal additives such as a binder resin component, a colorant made of a pigment or a dye, a plasticizer, a charge control agent, and, if required, magnetic particles and a release agent, and an external additive. As the binder resin component, natural or synthetic resin is used alone or in appropriate combination. The binder resin component and the other components are previously mixed in an appropriate proportion and kneaded by heat melting, followed by fine crushing and fine classification (if required), and the external additive is added to the mixture, whereby toner is obtained.

Hitherto, paying attention to the viscoelasticity of the toner, various suggestions have been made for the purpose of enhancing a fixing property of the toner.

For example, Japanese Laid-open Publication No. 5-100477 discloses binder resin having a loss modulus G"t of $1\times10^5$ dyn/cm$^2$ or less at 150° C. and a storage modulus G't of $2\times10^4$ dyn/cm$^2$ or more at 200° C., and a release agent with particular viscosity. However, due to a large value of G"t, transparency for an OHP and glossiness are not enhanced.

Furthermore, Japanese Laid-open Publication No. 6-59502 discloses toner having a loss modulus G"t of $10^4$ dyn/cm$^4$ or more at 150° C. and an apparent viscosity of 0.1 to $5\times10^3$ Pa·sec. In this structure, although resistance to hot offset is enhanced, satisfactory transparency for an OHP cannot be obtained due to a large value of G"t.

Still furthermore, Japanese Laid-open Publication Nos. 2-282757 and 7-77838 make suggestions regarding a toner size distribution and dynamic viscoelasticity. However, these publications pay attention to only dynamic viscoelasticity of toner regarding transparency for an OHP. In this case, the toner is designed paying attention to transparency for an OHP, so that hot offset is likely to occur. Thus, it is required to coat a fixing heat roll with a great amount of release oil such as silicone oil for the purpose of preventing hot offset.

Still furthermore, Japanese Laid-open Publication Nos. 2-190868 and 9-304965 describe the smoothness of a fixing surface. However, only dynamic viscoelasticity of toner and characteristics of binder resin are paid attention to, so that high transparency for an OHP and resistance to hot offset cannot be obtained simultaneously.

In the case where a release agent such as wax is added to toner for the purpose of preventing hot offset, when an added amount of the release agent is small, satisfactory effects cannot be obtained. Moreover, due to poor dispersibility of the release agent, toner flowability is decreased, and toner-filming and toner-spent occur. Specifically, an aggregated or liberated release agent adheres to a photoreceptor, a toner holder, and carrier to contaminate them.

Furthermore, while printing is repeated, toner with a particular size may be selectively developed. Since toner has size distribution, this phenomenon occurs due to the difference in flowability of individual particles, the difference in aggregation of toner, or variation of a composition.

When there is a great difference in flowability of individual toner particles, toner particles are variously charged by friction. This causes a variation in the amount of charge. In the case where toner having a particular size is selectively developed, size distribution of the toner which has remained without being developed changes, which decreases image density and increases fog. Furthermore, transfer efficiency is decreased, so that the smoothness of the surface of an image is decreased. As a result, transparency after fixing will not be enhanced.

Therefore, with the foregoing in mind, it is an object of the present invention to provide toner which realizes satisfactory transparency for an OHP, glossiness, and resistance to hot offset, which allows a high quality image to be formed, keeping high density and less fog for a long period of time, and which is capable of preventing toner-filming with respect to a photoreceptor, by specifying dynamic viscoelasticity of toner to improve the smoothness of an image surface. It is another object of the present invention to provide an electrophotographic method using the toner.

SUMMARY OF THE INVENTION

Toner of the present invention at least includes binder resin, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and the toner contains 5 to 50% by number of toner particles with a size of $2\times10^{-6}$ to $5\times10^{-6}$ m in size distribution of the toner.

Toner of the present invention at least includes binder resin, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and a compression ratio C calculated from a static density of the toner and a dynamic density thereof satisfies $5 \leqq C(\%) \leqq 40$.

Toner of the present invention at least includes binder resin, wax, a colorant, and an external additive, wherein a loss modulus G"t (frequency: 10 rad/s) of the toner at 170° C. satisfies $100 \leqq G''t \leqq 5000$ (Pa), and a storage modulus G't (frequency: 10 rad/s) of the toner at 190° C. satisfies $10 \leqq G't \leqq 3000$ (Pa).

Toner of the present invention at least includes binder resin, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), the toner contains 5 to 50% by number of toner particles with a size of $2\times10^{-6}$ to $5\times10^{-6}$ m in size distribution of the toner, and a compression ratio C calculated from a static density of the toner and a dynamic density thereof satisfies $5 \leqq C(\%) \leqq 40$.

Toner of the present invention at least includes binder resin, wax, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and the toner contains 5 to 50% by number of toner particles with a size of $2\times10^{-6}$ to $5\times10^{-6}$ m in size distribution of the toner.

Toner of the present invention at least includes binder resin, wax, a colorant, and an external additive, wherein a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}(G't/G'r) \leqq 2$, a loss modulus G"t (frequency: 10 rad/s) of the toner at 170° C. satisfies $100 \leqq G''t \leqq 5000$ (Pa), and a storage modulus G't (frequency: 10 rad/s) of the toner at 190° C. satisfies $10 \leqq G't \leqq 3000$ (Pa).

Toner of the present invention at least includes binder resin, wax, a colorant, and an external additive, wherein a storage modulus G'r (frequency: 10 rad/s) of the binder resin at 190° C. and a storage modulus G't (frequency: 10 rad/s) of the toner at 190° C. satisfy $0.15 \leqq \mathrm{Log}_{10}(G't/G'r) \leqq 2$, a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and a compression ratio C calculated from a static density of the toner and a dynamic density thereof satisfies $5 \leqq C(\%) \leqq 40$.

In one embodiment of the present invention, the above-mentioned toner is used for electrophotography at least including: making visible an electrostatic latent image on a photoreceptor by developing it with a two-component developer containing the toner of claim 1 and carrier; transferring the visible toner on the photoreceptor to a transfer sheet; and cleaning the photoreceptor by removing the toner, which has partially remained on the photoreceptor during the transfer, from the photoreceptor, wherein a relationship $Dc \times TD/Dv$ of a volume average size Dc (m) of the carrier, a volume average size Dv (m) of the toner, and a mixed ratio TD between the carrier and the toner is 0.20 to 0.45.

In another embodiment of the present invention, the above-mentioned toner includes the colorant in an amount of 2 to 15 parts by weight based on 100 parts by weight of the binder resin.

In another embodiment of the present invention, the above-mentioned toner includes the wax in an amount of 0.5 to 10 parts by weight based on 100 parts by weight of the binder resin.

In another embodiment of the present invention, an endothermic peak of the wax measured by DSC is 65° C. to 90° C.

In another embodiment of the present invention, the wax comprises at least one selected from the group consisting of carnauba wax, candelilla wax, hydrogenated jojoba oil, rice wax, hydrogenated lanolin, meadowfoam oil, bees wax, ceresin wax, and derivatives thereof An electrophotographic method of the present invention includes: making visible an electrostatic latent image on a photoreceptor by developing it with toner which includes binder resin, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and the toner contains 5 to 50% by number of toner particles with a size of $2\times10^{-6}$ to $5\times10^{-6}$ m in size distribution of the toner; transferring the visible toner on the photoreceptor to a transfer sheet; cleaning the photoreceptor by removing the toner, which has partially remained on the photoreceptor during the transfer, from the photoreceptor; and returning waste toner removed by the cleaning and re-cycling it.

In one embodiment of the present invention, a compression ratio C calculated from a static density of the toner and a dynamic density thereof satisfies $5 \leqq C(\%) \leqq 40$.

In another embodiment of the present invention, the toner further includes wax.

An electrophotographic method of the present invention includes: making visible an electrostatic latent image on a photoreceptor by developing it with toner which includes binder resin, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa), and a compression ratio C calculated from a static density of the toner and a dynamic density thereof satisfies 5≦C(%)≦40; transferring the visible toner on the photoreceptor to a transfer sheet; cleaning the photoreceptor by removing the toner, which has partially remained on the photoreceptor during the transfer, from the photoreceptor; and returning waste toner removed by the cleaning and re-cycling it.

An electrophotographic method of the present invention includes: making visible an electrostatic latent image on a photoreceptor by developing it with toner which includes binder resin, wax, a colorant, and an external additive, wherein a loss modulus G"t (frequency: 10 rad/s) of the toner at 170° C. satisfies 100≦G"t≦5000 (Pa), and a storage modulus G't (frequency: 10 rad/s) of the toner at 190° C. satisfies 10≦G't≦3000 (Pa); transferring the visible toner on the photoreceptor to a transfer sheet; cleaning the photoreceptor by removing the toner, which has partially remained on the photoreceptor during the transfer, from the photoreceptor; and returning waste toner removed by the cleaning and re-cycling it.

In one embodiment of the present invention, a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}$ (G't/G'r)≦2.

In another embodiment of the present invention, a compression ratio C calculated from a static density of the toner and a dynamic density thereof satisfies 5≦C(%)≦40.

An electrophotographic method of the present invention includes: making visible an electrostatic latent image formed on an image holder by developing it with toner which includes binder resin, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa), and the toner contains 5 to 50% by number of toner particles with a size of $2\times10^{-6}$ to $5\times10^{-6}$ m in size distribution of the toner; primary-transferring the toner to an endless intermediate transfer body, which is in contact with the image holder; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

In one embodiment of the present invention, a compression ratio C calculated from a static density of the toner and a dynamic density thereof satisfies 5≦C(%)≦40.

In another embodiment of the present invention, the toner further includes wax.

An electrophotographic method of the present invention includes: making visible an electrostatic latent image formed on an image holder by developing it with toner which includes binder resin, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa), and a compression ratio C calculated from a static density of the toner and a dynamic density thereof satisfies 5≦C(%)≦40; primary-transferring the toner to an endless intermediate transfer body, which is in contact with the image holder; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

An electrophotographic method of the present invention includes: making visible an electrostatic latent image formed on an image holder by developing it with toner which includes binder resin, wax, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa); primary-transferring the toner to an endless intermediate transfer body, which is in contact with the image holder; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

In one embodiment of the present invention, a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}$ (G't/G'r)≦2.

In another embodiment of the present invention, a compression ratio C calculated from a static density of the toner and a dynamic density thereof satisfies 5≦C(%)≦40.

An electrophotographic method of the present invention includes: making visible an electrostatic latent image formed on an image holder by developing it with toner which includes binder resin, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa), and the toner contains 5 to 50% by number of toner particles with a size of $2\times10^{-6}$ to $5\times10^{-6}$ m in size distribution of the toner; primary-transferring the toner to an endless intermediate transfer body, which is in contact with the image holder; cleaning the photoreceptor by removing the toner, which has partially remained on the photoreceptor during the primary-transfer, from the photoreceptor; returning waste toner removed by the cleaning to development and recycling it; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

In one embodiment of the present invention, a compression ratio C calculated from a static density of the toner and a dynamic density thereof satisfies 5≦C(%)≦40.

In another embodiment of the present invention, the toner further includes wax.

An electrophotographic method of the present invention includes: making visible an electrostatic latent image formed on an image holder by developing it with toner which includes binder resin, a colorant, and an external additive, wherein a loss modulus G"t (frequency: 10 rad/s) of the toner at 170° C. satisfies 100≦G"t≦5000 (Pa), a storage modulus G't (frequency: 10 rad/s) of the toner at 190° C. satisfies 10≦G't≦3000 (Pa), and a compression ratio C calculated from a static density of the toner and a dynamic density thereof satisfies 5≦C(%)≦40; primary-transferring the toner to an endless intermediate transfer body, which is in contact with the image holder; cleaning the photoreceptor by removing the toner, which has partially remained on the photoreceptor during the primary-transfer, from the photoreceptor; returning waste toner removed by the cleaning to development and recycling it; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

An electrophotographic method of the present invention includes: making visible an electrostatic latent image formed on an image holder by developing it with toner which includes binder resin, wax, a colorant, and an external additive, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa); primary-transferring the toner to an endless intermediate transfer body, which is in contact with the image holder; cleaning the photoreceptor by removing the toner, which has partially remained on the photoreceptor during the primary-transfer, from the photoreceptor; returning waste toner removed by the cleaning to development and recycling it; forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

In one embodiment of the present invention, a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}(G't/G'r) \leqq 2$.

In another embodiment of the present invention, a compression ratio C calculated from a static density of the toner and a dynamic density thereof satisfies $5 \leqq C(\%) \leqq 40$.

As described above, the toner of the present invention has particular viscoelasticity, size distribution, and compression ratio. Therefore, the toner smooths unevenness of an image surface, and allows a decrease in the amount of silicone oil to be provided to a fixing heat roller because of satisfactory dispersibility of a colorant. Furthermore, high transparency for an OHP with high glossiness can be maintained for a long period of time, and hot offset can be prevented. High image quality with high density and less fog can be realized, and toner-filming can be prevented with respect to a photoreceptor.

These and other advantages of the present invention will become apparent to those skilled in the art upon reading and understanding the following detailed description with reference to the accompanying figures.

DESCRIPTION OF THE PREFERRED EMBODIMENTS

Figure 1:
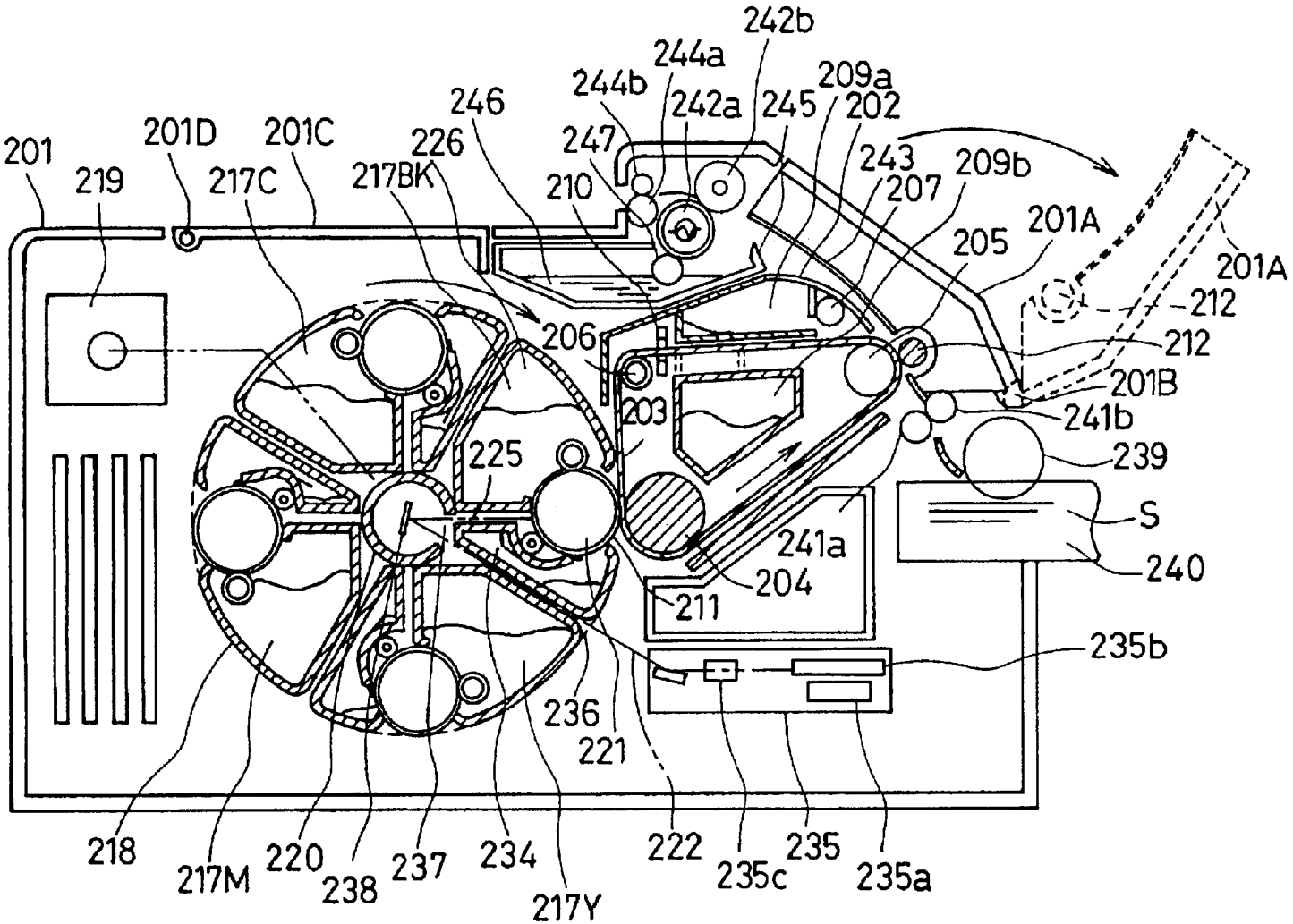
FIG. 1 is a cross-sectional view of an exemplary electrophotographic apparatus for electrophotography using toner of the present invention.

Hereinafter, toner, carrier, and an evaluation and measurement method will be described in this order.

I. Toner

I-1. Composition (1) Binder Resin

Conventionally, as binder resin to be contained in toner, various kinds of binder resin materials have been used, which are known as toner binder resins for electrophotography. Examples of the binder resin include polyester resins, styrene copolymers, epoxy resins, polyurethane resins, phenol resins, polyamide resins, and other known polymers or copolymers.

Among the above-mentioned examples, the present invention will become most effective in the case where polyester resins are used.

Polyester resin is composed of a polyhydric alcohol component and a polyvalent carboxylic acid component. Examples of the polyhydric alcohol component include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, glycerin, sorbitol, 1,4-sorbitan, and trimethylolpropane. Among them, bisphenol A represented by the following Formula 1, derivatives thereof, alkylene oxide adducts thereof, hydrogenated bisphenol A, and the like are preferably used.

Formula 1

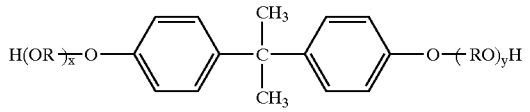

wherein R represents an ethylene group or a propylene group; x and y are integers of 1 or more, respectively; and an average of x+y is 2 to 10.

Examples of the polyvalent carboxylic acid component include maleic acid, maleic anhydride, fumaric acid, phthalic acid, terephthalic acid, isophthalic acid, malonic acid, succinic acid, glutaric acid, dodecenylsuccinic acid, n-dodecenylsuccinic acid, n-octyl succinate, 1,2,4-benzenetricarboxylic acid, 1,2,4-cyclohexanetricarboxylic acid, 1,2,4-naphthalenetricarboxylic acid, 1,2,5-hexanetricarboxylic acid, trimellitic acid, pyromellitic acid, and lower alkyl esters of these acids.

Furthermore, polyester resin may be reacted with an isocyanate compound to obtain urethane modified polyester. Examples of the isocyanate compound include hexamethylene diisocyanate, isophorone diisocyanate, tolylene diisocyanate, diphenylmethane diisocyanate, xylylene diisocyanate, and tetramethylxylylene diisocyanate. The amount of the isocyanate compound to be used is preferably 0.5 to 0.95 molar equivalent weight per mole of hydroxyl of polyester resin before being modified with urethane.

A melt index, which represents viscosity of binder resin during melting, is preferably 0.2 to 100 g/10 min. under a weight of 216 g at 125° C. When the melt index of binder resin is less than 0.2 g/10 min., a crushing property in the course of production of toner will be degraded, resulting in decreased productivity. When the melt index of binder resin is more than 100 g/10 min., viscosity of the binder resin will be decreased during melting; therefore, a colorant cannot be uniformly dispersed due to a poor kneading force. As a result, transparency for an OHP is not enhanced.

Furthermore, in order to keep stiffness of the binder resin to such a degree that toner will not be broken during development or cleaning, and in order to enhance a crushing property during production and dispersibility of a release component such as wax during kneading by melting, it is required to specify a softening point, a weight-average molecular weight, a number-average molecular weight, a glass transition point, and a tetrahydrofuran (THF) insoluble amount of the binder resin.

The weight-average molecular weight Mw of the binder resin is 7500 to 100000, preferably 8500 to 70000. The number-average molecular weight Mn of the binder resin is 2000 to 20000. The peak molecular weight in a molecular weight distribution is preferably 3500 to 10000.

When the weight-average molecular weight Mw is less than 7500, the stiffness of the binder resin will be decreased to cause toner particles to be broken during development or cleaning. When the weight-average molecular weight Mw is more than 100000, a crushing property during production will be decreased. When the number-average molecular weight Mn is less than 2000, excessive crushing will occur during crushing in the course of production, and toner production yield will be decreased. When the number-average molecular weight Mn is more than 10000, transparency for an OHP will be decreased.

The softening point of the binder resin is 90° C. to 150° C., preferably 100° C. to 140° C., more preferably 105° C. to 130° C. When the softening point of the binder resin is less than 90° C., strength of the binder resin will become low. When the softening point of the binder resin is more than 150° C., an amount of heat required for fixing will be increased. Therefore, it is required to increase a fixing temperature or decrease a fixing speed.

The glass transition point of the binder resin is 50° C. to 70° C., preferably 50° C. to 65° C. When the glass transition point is less than 50° C., the storage stability of toner will be decreased. When the glass transition is more than about 70° C., an amount of heat required for fixing will be increased, which requires an enlarged fixing unit.

The THF insoluble amount of the binder resin is preferably 20% by weight or less. When the THF insoluble amount is more than 20% by weight, a crushing property of toner in the course of production will be remarkably decreased.

(2) Wax

Wax preferably has an endothermic peak of 65° C. to 90° C. measured by differential scanning calorimetry (DSC), and is preferably composed of at least one selected from the group consisting of carnauba wax, candelilla wax, hydrogenated jojoba oil, rice wax, hydrogenated lanolin, meadowfoam oil, and derivatives thereof.

Since the above-mentioned waxes have an endothermic peak of 65° C. to 90° C., they are melted at a lower temperature than the melting point of the binder resin to exude to the surface of toner. Therefore, these waxes smoothen an image surface by filling the unevenness thereon during fixing. Thus, transparency for an OHP is enhanced.

Furthermore, in order to enhance a fixing property during fixing by a heat roll and prevent hot offset with respect to a heat roller, polyolefin wax such as low molecular-weight polypropylene, low molecular-weight polyethylene, polybutene, and polyhexene may be used alone or in combination.

The amount of the polyolefin wax to be added is preferably 0.5 to 10 parts by weight based on 100 parts by weight of the binder resin. When the added amount of the polyolefin wax is less than 0.5 parts by weight, satisfactory effects cannot be obtained. When the added amount of the polyolefin wax is more than 10 parts by weight, toner-filming occurs with respect to a photoreceptor, and charge on the surface of the photoreceptor is lost in a high humidity atmosphere, resulting in image flow.

Preferably, the polyolefin wax is at least composed of low molecular-weight polyethylene wax obtained by pyrolysis. It is also preferable that a recovery ratio of the polyolefin wax is 95% or more when washed with toluene at 25° C. for one hour. The softening point of the polyolefin is preferably 80° C. to 140° C., and the penetration number thereof is 8 or less at 25° C. In this case, a toner fixing property is enhanced due to a low softening point of the polyolefin wax, and resistance to toner-filming with respect to a photoreceptor is enhanced due to a decreased content of a component with a low boiling point. Pyrolysis is utilized in the course of preparing low molecular-weight polyethylene wax, so that a component with a low boiling point is vaporized, and becomes unlikely to be contained in the low molecular-weight polyethylene wax. A substance which is melted in and removed by toluene is mostly a component having a low boiling point in the low molecular-weight polyethylene wax. Therefore, the low molecular-weight polyethylene wax, which has a high recovery ratio after washing with toluene, contains less component having a low boiling point. When the softening point of the low molecular-weight polyethylene wax is less than 80° C., a storage property of toner will be decreased. Furthermore, in this case, a wax component adheres to the surfaces of carrier and toner holders. When the softening point is more than 140° C., a release effect will not be exhibited. When the penetration number of the low molecular-weight polyethylene wax is more than 8 at 25° C., flowability of toner will be decreased.

Wax may be added to a binder resin solution in a total amount to be added to toner, or may be partially added in a preliminary mixing step. Because of the wax previously added to the binder resin solution, even when wax is added and kneaded later, the wax will be uniformly dispersed.

(3) Colorant

Examples of a pigment or a dye used for a colorant include carbon black, iron black, graphite, nigrosine, a metal complex of azo dyes, anthraquinone dyes, phthalocyanine blue, Du Pont oil red, aniline blue, benzine yellow, Hansa yellow, rose bengal, rhodamine lake, alizarin lake, C.I. Pigment·Red 22, 31, 48-1, 48-3, 53-1, 57-1, 60, C.I. Pigment·Yellow 12, 13, 14, 17, 81, 97, 154, 155, 174, 180, C.I. Pigment·Blue 15, 15-3, 15-4, 15- 6, 60, and mixtures thereof If required, magnetic particles can be added as a colorant. Examples of the magnetic particles include powder of metal such as iron, manganese, nickel, and cobalt, and ferrite powder of manganese, nickel, cobalt, zinc, and the like. An average size of powder is preferably 1 $\mu$m or less, particularly 0.6 $\mu$m or less.

The content of the colorant is preferably 2 to 15 parts by weight based on 100 parts by weight of the binder resin. When the content of the colorant is less than 2 parts by weight, the coloring power will become weak. When the content of the colorant is more than 15 parts by weight, even if the surface of a fixed image is smoothed, transparency for an OHP will be decreased.

In order to enhance dispersibility of a colorant, a so-called master batch may be produced by previously kneading a colorant with binder resin by melting. In this case, the content of the colorant in the master batch is preferably 60 parts by weight or less. When the content of the colorant is more than 60 parts by weight, dispersibility of the colorant will be decreased. Therefore, even if the surface of a fixed image is smoothed, transparency for an OHP will be decreased.

(4) External Additive

Examples of the external additive include fine powder of metal oxide such as silica, alumina, titania, zirconia, magnesia, ferrite, and magnetite; carbide such as tungsten carbide; nitride; titanate such as barium titanate, calcium titanate, and strontium titanate; zirconate such as barium zirconate, calcium zirconate, and strontium zirconate; and mixtures thereof. The external additive may be subjected to surface treatment (e.g., being rendered hydrophobic), if required.

(5) Other Components

A charge control agent may be used for the purpose of controlling frictional electrification of toner. A charge control agent is classified into a positive charge control agent and a negative charge control agent, which can be used alone or in combination in accordance with the purpose. Examples of the positive charge control agent include organic compounds containing basic nitrogen atoms such as basic dyes, nigrosine, pyrimidine compounds, aminosilanes, and quarternary ammonium salts. Examples of the negative charge control agent include metal-containing azo dyes, metal salts of alkyl salicylic acid, metal salts of naphthenic acid, and fatty acid soap.

Furthermore, if required, Teflon, zinc stearate, polyvinylidene fluoride and the like can be used as a release agent, a flowable auxiliary agent, a charge auxiliary agent, and a cleaning auxiliary agent.

I-2. Production Method

Toner is produced at least by each step of auxiliary mixing, kneading, fine crushing, fine classification, and external addition.

In the auxiliary mixing step, binder resin, a colorant, and the like are uniformly dispersed by a mixer or the like equipped with a stirring blade. Herein, a known method is used.

In the following examples, a Henschel mixer FM-20B (produced by Mitsui Miike Chemical Enginerring Co.) is used for the auxiliary mixing.

In the kneading step, the mixed material is heated, and the colorant and the like are dispersed in the binder resin by a shear force. Kneading is performed by a known heat kneader of the three-roll type, uniaxial screw type, biaxial screw type, Banbury mixer type, or the like, in which a mixture is kneaded by heating under a shear force. In the following examples, a mixture is kneaded by heating, using a biaxial kneader PCM-30 (produced by Ikegai Corporation).

Then, an aggregate obtained by the kneading step is roughly crushed, for example, by a cutter mill, followed by fine crushing. In the fine crushing step, an air crusher such as a jet mill crusher or a mechanical crusher such as a rotor type crusher is used. In order to suppress generation of ultra-fine toner and liberated grains during fine crushing and to enhance yield, rough crushing is performed prior to fine crushing. In the rough crushing step, a material is preferably crushed to about 2 mm or less. Alternatively, intermediate crushing may be preferably introduced between the rough crushing step and the fine crushing step, in which a material is crushed to about 100 $\mu$m or less. After the fine crushing step, fine classification is performed. In the fine classification step, fine powder is removed by classification.

In the external addition step, an external additive is added to be mixed. (In the following examples, the external addition step is performed either before or after the fine classification step.) In this step, a known mixer can be used.

In the present embodiment, it is required strictly to control the % by number of toner particles with a size of $2\times10^{-6}$ to $5\times10^{-6}$ m in a toner size distribution.

The above-mentioned % by number of toner particles with a size of $2\times10^{-6}$ to $5\times10^{-6}$ m shows a proportion of fine powder contained in toner. Fine powder in toner affects flowability of toner, image quality, storage stability, toner-filming with respect to a photoreceptor and a toner holder, and characteristics with passage of time, as well as transparency for an OHP and a hot offset property.

It is considered that the reason why transparency for an OHP is influenced is that fine powder in the above-mentioned range smooths the unevenness of an image surface before fixing. In the case where an image is fixed after its surface is smoothed, light diffusion is reduced, so that transparency for an OHP is enhanced. However, fine powder has large adhesion to a heat roller, and therefore, hot offset is likely to occur. In the case where fine powder exceeding the above-mentioned range is contained in toner, an image surface after fixing becomes rough due to occurrence of hot offset. Therefore, transparency for an OHP is decreased.

In order to set the above-mentioned predetermined value, a mechanical classification method or an air classification method is used. According to the mechanical classification method, toner particles are classified by a centrifugal force of a rotor which is rotated during the fine classification step. According to the air classification method, a swirl is generated by aspiration of the air so as to allow a centrifugal force to act on toner particles. A multifractionated classification apparatus utilizing a Coanda effect also can be used. Since this apparatus allows toner particles to be satisfactorily dispersed in the fine classification step, a classification precision of ultra-fine toner and liberated grains is enhanced.

Fine powder to be separated in the fine classification step can be partially or entirely returned to the auxiliary mixing step or the kneading step. The separated fine powder may be solidified into pellets for the purpose of enhancing an auxiliary mixing property. A roller compactor or the like can be used for solidification.

II. Carrier

Carrier is produced by providing a resin coating layer onto the surface of a ferrite particle.

As a crude material for a ferrite, $Fe_2O_3$ (main component) is mixed with NiO, CuO, CoO, MgO, ZnO, $MnCO_3$, $BaCO_3$, and $SrCO_3$.

A ferrite particle may be produced by a wet method or a dry method. The dry method is preferable. According to the dry method, a crude material is mixed and provisionally sintered. Thereafter, the resultant mixture is finely crushed by a ball mill or the like in water. Polyvinyl alcohol (PVA) as a binding agent, an antifoaming agent, and a dispersant are added to the crushed mixture to obtain a slurry for size granulation. The slurry is granulated while being dried by heating with a spray dryer to obtain granules, followed by sintering. Sintering is performed at 900° C. to 1400° C. for 10 to 30 hours. Thereafter, the resultant granules are cracked and classified to obtain ferrite particles.

The resin coating layer is obtained by a known method such as a spray method and a dipping method. The amount of coating is 0.3 to 1.2% by weight based on the total weight of carrier particles.

As resin used for the resin coating layer, fluorocarbon resin or silicone resin is used. Carbon black contained in the resin coating layer can be produced by various methods. However, oil furnace carbon and acetylene black are preferable. Furthermore, the surface of the carbon black may be grafted or oxidized.

An average size of a carrier particle is preferably $40\times10^{-6}$ m to $100\times10^{-6}$ m. When an average size of a carrier particle is less than $40\times10^{-6}$ m, the carrier will be likely to be developed by a photoreceptor and to generate scratches on the photoreceptor during cleaning. When an average size of a carrier particle is more than $100\times10^{-6}$ m, a toner holding force of the carrier will become weakened, resulting in scattering of toner.

III. Evaluation and Measurement Method (1) Melt Index

A melt index represents the weight of binder resin which has flowed from an orifice under a predetermined load at a predetermined temperature for a predetermined period of time. In an experiment, the weight of binder resin that has flowed under a load of 2160 g at 125° C. for 10 minutes was measured as a melt index by a melt indexer in accordance with JIS K 6760. A large melt index means that binder resin is melted by heating at the temperature and becomes likely to flow.

(2) Softening Point

A softening point is obtained as follows. By using a Koka-type flow tester CFT-500C (produced by Shimadzu Corporation), a sample with a size of 1 $cm^3$ is provided with a load of 20 $kg/cm^2$ by a plunger while being heated at a rate of 6° C./min., and is extruded through a nozzle with a diameter of 1 mm and a length of 1 mm. A temperature corresponding to ½ of the characteristic line of the lowered amount of the plunger and the rising temperature is determined as a softening point.

(3) Molecular Weight Distribution

As a molecular weight, a value is used, which is measured by gel permeation chromatography (GPC) using various kinds of monodisperse polystyrenes as a standard sample. Tetrahydrofuran (THF) is flowed as a solvent at about 1 ml/min. and 25° C., and a tetrahydrofuran sample solution with a concentration of 0.5 g/dl is injected in an amount of 10 mg (sample weight), whereby measurement is conducted. The following measurement condition is selected: a molecular weight distribution of a target sample is included in a range in which a logarithm and a count number of a molecular weight in a calibration curve obtained in various kinds of monodisperse polystyrene standarad samples become a straight line.

(4) THF (Tetrahydrofuran) Insoluble Amount

The THF insoluble amount refers to filter paper insoluble amount (% by weight) when a sample is dissolved in THF and left at room temperature. In the case of binder resin, this refers to a content of a cross-linking component.

(5) Glass Transition Point and DCS Endothermic Peak Temperature, and Wax Characteristics A glass transition point (Tg) and a DSC endothermic peak temperature were measured from a DSC curve obtained by increasing a temperature to 150° and cooling it at about 7.5° C./min., using a differential scanning calorimeter DSC-50 (produced by Shimadzu Corporation).

The softening point of wax was measured in accordance with JIS K 2207-6.4-93, using, as an index, a temperature at which wax was melted.

The penetration number was measured at 25° C. in accordance with JIS K 2235-6.3-93 as an index showing hardness of wax at room temperature.

The recovery ratio by washing with toluene was calculated as follows. One hundred grams of wax was introduced into 1000 ml of toluene at 25° C., and the mixture was stirred for one hour. Thereafter, the entire amount was filtered with filter paper, and an extraction residue on the filter paper was thoroughly dried at room temperature. The weight before and after washing was measured, whereby a recovery ratio was calculated.

(6) Size Distribution

A toner size distribution can be measured by various methods. According to the present invention, a toner size distribution was measured by a Coulter Multisizer (produced by Coulter Electronics, Inc.) and a personal computer for data processing.

As an electrolyte, Isotone II (produced by Coulter Electronics, Inc.) was used.

About 2 mg of toner to be measured was added to about 50 ml of an electrolyte in which a surfactant (sodium lauryl sulfate) was added so as to obtain a concentration of 1%, and was subjected to ultrasonic dispersion for three minutes, whereby a measurement sample was obtained.

An aperture diameter of the Coulter Multisizer was determined as $70\times10^{-6}$ m. In the case of using an aperture of this size, a measurement range of size distribution is $1.26\times10^{-6}$ to $50.8\times10^{-6}$ m. Aregion with size distribution of less than $2\times10^{-6}$ m is not practical since measurement precision and reproducibility of measurement are low due to the influence of external noises and the like. Thus, a measurement region was determined as $2.00\times10^{-6}$ to $50.8\times10^{-6}$ m. A volume average size Dv of toner and % by number of toner particles in $2\times10^{-6}$ to $5\times10^{-6}$ m in this region were calculated. A volume average size Dc of carrier was measured by using a Microtrack (produced by Nikkiso Co., Ltd.).

(7) Compression Ratio

A compression ratio of toner was calculated by the following expression by measuring a static density and a dynamic density.

$$\text{Compression ratio C (\%)} \leqq (1-(\text{Static density})/(\text{Dynamic density}))\times 100$$

A compression ratio is an index of flowability of powder. A smaller compression ratio means higher flowability. A static density and a dynamic density were measured by using a Powder Tester PT-E (produced by Hosokawa Micron Co.). An index of flowability may be represented based on a static density alone. A compression ratio is calculated based on both static characteristics and dynamic characteristics of toner; therefore, the compression ratio is capable of describing the movement of toner more satisfactorily.

(8) Amount of Charge

An amount of charge was measured by using a blow-off measuring device TB-200 (produced by Toshiba Co.). The carrier described in the above item II also was used for a copying test. A sample to be measured was obtained as follows. Cu-Zn-$Fe_2O_3$ particles with an average size of $60\times10^{-6}$m and a volume resistivity of $3\times10^8$ Ω·cm were used as carrier, which were coated with silicone resin containing 8% by weight of carbon black with a DBP (dibutyl phthalate) oil absorptivity of 360 ml/100 g, a specific surface area of 800 $m^2/g$, and pH8. Toner was mixed with the particles so as to obtain a toner concentration of 5.0%. The resultant mixture was placed in a 100 ml polyethylene bottle, and stirred at 100 r.p.m. for 10 minutes, whereby a sample to be measured was obtained.

DBP oil absorptivity is obtained as follows. Twenty grams of sample dried at 150° C.±1° C. for one hour are placed in a mixing chamber of an absorbed meter (produced by Brabender, tension of spring: 2.68 kg/cm). A limit switch is previously set at about 70% (maximum torque), and thereafter, a mixer is rotated. Simultaneously, DBP (specific gravity: 1.045 to 1.050 $g/cm^3$) is added at a rate of 4 ml/min. from an automatic burette. When a final point is approached, the torque is rapidly increased, and the limit switch is turned off. The DBP oil absorptivity per 100 g of sample is obtained from the added DBP amount and the weight of the sample.

pH was measured as follows. About 100 ml of distilled water was added to 10 g of sample. The mixture was boiled on a hot plate for 10 minutes, and cooled to room temperature. Thereafter, the supernatant was removed, and the pH of a remaining muddy substance was measured by a pH meter with a glass electrode.

The volume resistivity of the carrier was measured as follows. 0.2 g of sample carrier was placed in a region where electrodes with a size of 2×1 cm face each other at a distance of 2 mm. A bridge was formed between the electrodes by magnets provided outside the electrodes so as to be opposed to each other, and the volume resistivity was measured under the application of a voltage of 1000 volts to the electrodes.

(9) Dynamic Viscoelasticity Characteristics

A loss modulus and a storage modulus were measured by using a viscoelasticity measuring device RDA-II (produced by Rheometrix Co.) and a parallel plate with a diameter of 20 mm. The measurement frequency, measurement temperature, and temperature rising rate were determined as 10 rad/s, 100° C. to 250° C., and 2.0° C./min., respectively.

Since an effective fixing time of a heat roll fixing unit is about $1\times10^{-2}$ to $5\times10^{-2}$ sec., a frequency corresponding to this was determined as a measurement frequency.

(10) Image Density

An image density was measured by a reflection densiometer (produced by Macbeth Co.) and evaluated.

(11) Transparency for an OHP

An OHP sheet CG3710 (produced by Sumitomo 3M Limited) with a matte image (adhesion amount: 0.4 mg/cm$^2$) formed thereon was used as a measurement sample. Transparency for an OHP was obtained by measuring transmittance of 700 nm light by a spectrophotometer U-3200 (produced by Hitachi, Ltd.)

(12) Hot Offset Property

A hot offset property was quantified by a temperature at which hot offset was started. The temperature of a fixing unit was increased by 5° C. at a time under a process speed of 52.5 mm/s, and a temperature at which hot offset was started was visually evaluated.

Embodiment 1

Toner of the present embodiment has a loss modulus G"t (frequency: 10 rad/s) of $100\leqq G''t\leqq5000$ (Pa) at 170° C. and a storage modulus G't (frequency: 10 rad/s) of $10\leqq G't\leqq3000$ (Pa) at 190° C. The toner of the present embodiment contains 5 to 50% by number of toner particles with a size of $2\times10^{-6}$ to $5\times10^{-6}$ m in size distribution of toner.

Among the dynamic viscoelasticity characteristics of toner, the loss modulus is an index of toner viscosity, and the storage modulus is an index of toner elasticity. Toner with strong viscosity is easily deformed by melting with a heat roller, and its surface is smoothed, so that transparency for an OHP is satisfactory. However, cohesion between toner particles and in toner particles is small, so that such toner is likely to cause hot offset with respect to a heat roller. Toner with strong elasticity has small strain under a pressure from a heat roller. Therefore, the surface of such toner is not smoothed, and transparency for an OHP is low; however, such toner is not likely to cause hot offset. More specifically, in order to obtain satisfactory transparency for an OHP and glossiness, it is desired that toner has low viscosity and elasticity. On the other hand, it is desired that toner has high elasticity with respect to a hot offset property. Thus, it is very difficult simultaneously to satisfy transparency for an OHP, glossiness, and a hot offset property.

On the other hand, toner with a size of $2\times10^{-6}$ to $5\times10^{-6}$ greatly affects smoothness of the surface of an image before fixing. Toner with a size of $2\times10^{-6}$ to $5\times10^{-6}$ m fills micro-unevenness on the surface of an image during development and transfer, and functions so as to obtain high transparency for an OHP after fixing.

The toner of the present embodiment has a loss modulus G"t (frequency: 10 rad/s) of $100\leqq G''t\leqq5000$ (Pa) at 170° C. and a storage modulus G't (frequency: 10 rad/s) of $10\leqq G't\leqq3000$ (Pa) at 190° C. The toner of the present embodiment contains 5 to 50% by number of toner particles with a size of $2\times10^{-6}$ to $5\times10^{-6}$ m in size distribution. Therefore, the toner of the present embodiment allows high transparency of an OHP and resistance to hot offset to be obtained.

In the case where G"t is less than 100 (Pa), viscosity of toner increases to cause hot offset with respect to a heat roller. In the case where G"t is more than 5000 (Pa), the surface of an image after fixing is not smoothed, which decreases transparency for an OHP. In the case where G't is less than 10 (Pa), although a temperature at which fixing is started is decreased, hot offset occurs. In the case where G't is more than 3000 (Pa), although hot offset does not occur, an image is obtained without high transparency for an OHP.

Toner with a size of $2\times10^{-6}$ to $5\times10^{-6}$ m is preferably 5 to 50% by number of particles, more preferably 10 to 40% by number of particles.

In the case where toner with a size of $2\times10^{-6}$ to $5\times10^{-6}$ m is less than 5% by number of particles, flowability of toner and an image density thereof during printing become high. However, unevenness on the surface of an image is conspicuous, so that transparency for an OHP is not enhanced. In the case where toner with a size of $2\times10^{-6}$ to $5\times10^{-6}$ m is more than 50% by number of particles, a transfer efficiency is low and the surface of an image becomes rough, so that transparency for an OHP is decreased. Furthermore, in this case, adhesion of toner to a heat roller becomes strong, so that a hot offset problem becomes more serious.

Embodiment 2

The toner of the present embodiment has a loss modulus G"t (frequency: 10 rad/s) of $100\leqq G''t\leqq5000$ (Pa) at 170° C. and a storage modulus G't (frequency: 10 rad/s) of $10\leqq G't\leqq3000$ (Pa) at 190° C. A compression ratio C calculated from a static density and a dynamic density of toner is $5\leqq C\ (\%)\leqq40$.

The compression ratio of toner is an index of toner flowability. The flowability of the toner is influenced by the size distribution of the toner, shape of toner particles, and the kind and amount of an external additive. In the case where the size distribution of toner is narrow and there is less fine powder, in the case where toner has a substantially spherical shape with less unevenness on the surface thereof, in the case where the added amount of an external additive is large, and in the case where the size of an external additive is small, a compression ratio becomes small, and toner flowability become high.

The compression ratio C is preferably $5\leqq C\ (\%)\leqq40$, more preferably $10\leqq C\ (\%)\leqq30$. Toner having a compression ratio of less than 5% has high flowability, and an image obtained by using such toner is not rough before fixing; however, transparency for an OHP after fixing is low. The reason for this is considered as follows: an external additive and the like prevents toner particles from melting to be combined with each other during fixing. Toner having a compression ratio more than 40% has low flowability, and the surface of toner before fixing is rough and conspicuous unevenness is found thereon. In this case, an image after fixing has inconsistencies, and transparency for an OHP and glossiness are low.

Embodiment 3

Toner of the present embodiment at least contains binder resin, wax, a colorant, and an external additive. The toner of the present embodiment has a loss modulus G"t (frequency: 10 rad/s) of 100≦G"t≦5000 (Pa) at 170° C. and a storage modulus G't (frequency: 10 rad/s) of 10≦G't≦3000 (Pa) at 190° C.

In the case where wax is added to toner, the added wax cooperates with the resin to enhance resistance to hot offset. The reason for this is that wax is melted during fixing to enhance a release property between the toner and the heat roller. Furthermore, melted wax fills the unevenness on the surface of an image, so that transparency for an OHP is improved.

Embodiment 4

Toner of the present embodiment at least contains binder resin, a colorant, wax, and an external additive. In the present embodiment, a storage modulus G'r (frequency: 10 rad/s) of the binder resin at 190° C. and a storage modulus G't (frequency: 10 rad/s) of the toner at 190° C. have a relationship $0.15 \leqq \log_{10}$ (G't/G'r)≦2. The toner of the present embodiment has a loss modulus G"t (frequency: 10 rad/s) of 100≦G"t≦5000 (Pa) at 170° C. and a storage modulus G't (frequency: 10 rad/s) of 10≦G't≦3000 (Pa) at 190° C.

Therefore, an image having high transparency for an OHP is obtained without liberation and unsatisfactory dispersion of wax.

$\text{Log}_{10}$ (G't/G'r) represents a ratio between a storage modulus of binder resin and that of toner. The storage modulus of toner increases more than that of binder resin during kneading due to the influence of a colorant and the like. The case where this value is less than 0.15 represents that a colorant and the like is not thoroughly dispersed in binder resin. Therefore, wax is not uniformly dispersed in binder resin; as a result, toner-filming occurs with respect to a photoreceptor and a toner holder. The case where $\text{Log}_{10}$ (G't/G'r) is more than 2 represents that the storage modulus G'r of binder resin is low or binder resin is thickened. Thus, dispersion of binder resin becomes non-uniform, and wax is partially liberated from the toner. Therefore, transparency for an OHP is decreased, and toner-filming occurs with respect to a photoreceptor and a toner holder.

Embodiment 5

Toner of the present embodiment at least contains binder resin, a colorant, wax, and an external additive. In the present embodiment, a storage modulus G'r (frequency: 10 rad/s) of the binder resin at 190° C. and a storage modulus G't (frequency: 10 rad/s) of the toner at 190° C. have a relationship $0.15 \leqq \log_{10}$ (G't/G'r)≦2. The toner of the present embodiment has a loss modulus G"t (frequency: 10 rad/s) of 100≦G"t≦5000 (Pa) at 170° C. and a storage modulus G't (frequency: 10 rad/s) of 10≦G't≦3000 (Pa) at 190° C. A compression ratio C calculated from a static density and a dynamic density of toner is 5≦C (%)≦40.

Therefore, there is no decrease in flowability of toner due to liberation and unsatisfactory dispersion of wax. Toner does not aggregate using liberated wax as a core. Thus, an image with high transparency for an OHP is obtained.

In the case where the compression ratio C is less than 5%, wax is completely and uniformly dispersed in binder resin. In this case, the effect of addition of wax is not obtained, and transparency for an OHP is not enhanced. Furthermore, in the case where the compression ratio C exceeds 40%, wax is liberated from toner, and liberated wax becomes a core to generate aggregates of toner. Therefore, dotted defects are generated on an image. The dotted defects decrease transparency for an OHP and appear as black points on a projected image.

Embodiment 6

Toner of the present embodiment is used for electrophotography including a developing step of making visible a latent image on a photoreceptor by using a two-component developer made of toner and carrier, a transfer step of transferring a visible latent image on the photoreceptor to a transfer sheet, and a cleaning step of removing toner partially remaining on the photoreceptor during the transfer step from the photoreceptor. The toner at least contains binder resin, a colorant, and an external additive. The toner has a loss modulus G"t (frequency: 10rad/s) of 100≦G"t≦5000 (Pa) at 170° C. and a storage modulus G't (frequency: 10 rad/s) of 10≦G't≦3000 (Pa) at 190° C. The toner contains 5 to 50% by number of toner particles with a size of $2\times10^{-6}$ to $5\times10^{-6}$ m in size distribution of toner. Dc×TD/Dv is 0.20 to 0.45, where Dc represents a volume average size (m) of carrier, Dv represents a volume average size (m) of toner, and TD represents a mixed ratio between the carrier and the toner.

Toner becomes charged to a predetermined amount by friction with carrier. In the case where friction between the toner and the carrier is insufficient or excessive, an amount of charge is varied, and adhesion of the toner to the carrier (toner-spent) occurs. Consequently, an image density is decreased, toner is scattered, and fog is increased. Furthermore, the surface of an image becomes rough.

In the present embodiment, Dc×TD/Dv is 0.20 to 0.45, preferably 0.25 to 0.40. In this case, the amount of toner adhering to carrier becomes appropriate. Therefore, charging by friction of toner and carrier is stabilized, and there are no fog and roughness of an image surface due to scattering of toner and toner charged with an opposite polarity.

Dc×TD/Dv represents a proportion of toner occupying the surface of carrier. In the case where Dc×TD/Dv is less than 0.2, an amount of charge of toner becomes excessive, and a satisfactory image density cannot be obtained. Furthermore, roughness and inconsistencies of an image surface are caused, which decreases transparency for an OHP. In the case where Dc×TD/Dv exceeds 0.45, an amount of charge of toner is varied, and toner is scattered. Furthermore, an efficiency of transfer from a photoreceptor is decreased, resulting in a rough image surface. Therefore, transparency for an OHP after fixing is not enhanced.

Embodiment 7

Toner of the present embodiment is used for electrophotography including a developing step of making visible a latent image on a photoreceptor by using a two-component developer made of toner and carrier, a transfer step of transferring a visible latent image on the photoreceptor to a transfer sheet, and a cleaning step of removing toner partially remaining on the photoreceptor during the transfer step from the photoreceptor. The toner at least contains binder resin, a colorant, wax, and an external additive. The toner has a loss modulus G"t (frequency: 10 rad/s) of 100≦G"t≦5000 (Pa) at 170° C. and a storage modulus G't (frequency: 10 rad/s) of 10≦G't≦3000 (Pa) at 190° C. Dc×TD/Dv is 0.20 to 0.45, where Dc represents a volume average size (m) of a carrier particle, Dv represents a volume average size (m) of toner, and TD represents a mixed ratio between the carrier and the toner.

In the present embodiment, dispersibility of wax is satisfactory. Therefore, even when mixed with carrier, wax is not liberated. Toner is charged by receiving stress from carrier. However, in the case where the stress from the carrier is excessive, wax may be liberated from toner, and toner itself may be broken to change size distribution. In the case where Dc×TD/Dv is less than 0.20, the stress from the carrier becomes excessive, and aggregates caused by liberated wax generate black points on an image. In the case where Dc×TD/Dv exceeds 0.45, waste toner is increased, and toner is scattered.

EXAMPLES

Example 1

FIG. 1 is a cross-sectional view of an exemplary electrophotographic apparatus for use in electrohpotography according to the present invention. In the present example, although a two-component developer is used for development, the present invention is not limited thereto. A one-component developer also may be used.

Hereinafter, an operation during color image forming will be described with reference to FIG. 1.

Reference numeral 201 denotes an outer housing of a color electrophotographic printer. The right side on the drawing surface corresponds to a front surface of the printer. Reference numeral 201A denotes a printer front surface plate. The printer front surface plate 201A is hinged on a hinge axis 201B disposed on a lower side of the printer front surface plate 201A, so as to be opened as represented by a dotted line and closed as represented by a solid line. Inspection, maintenance, and the like in the printer, such as attachment/detachment of an intermediate transfer belt unit 202 to/from the printer and paper jamming, are performed by opening the printer front surface plate 201A to allow the inside of the printer to be seen well. Attachment/detachment of the intermediate transfer unit belt unit 202 is designed in such a manner as to be performed in a direction perpendicular to a main line direction of a rotation axis of a photoreceptor.

Figure 2:
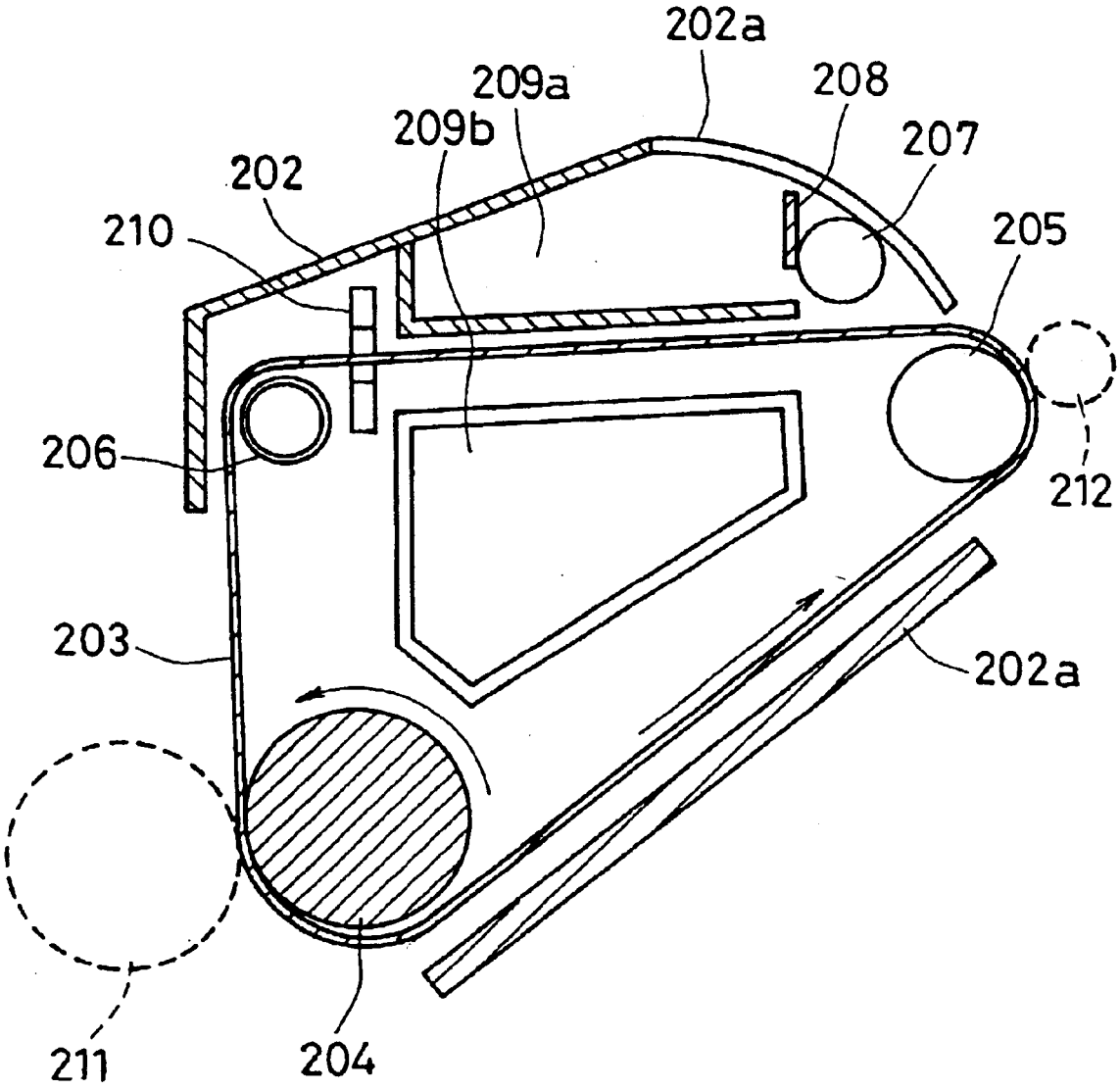
FIG. 2 is a view showing a structure of an intermediate transfer belt unit according to the present invention.
Figure 3:
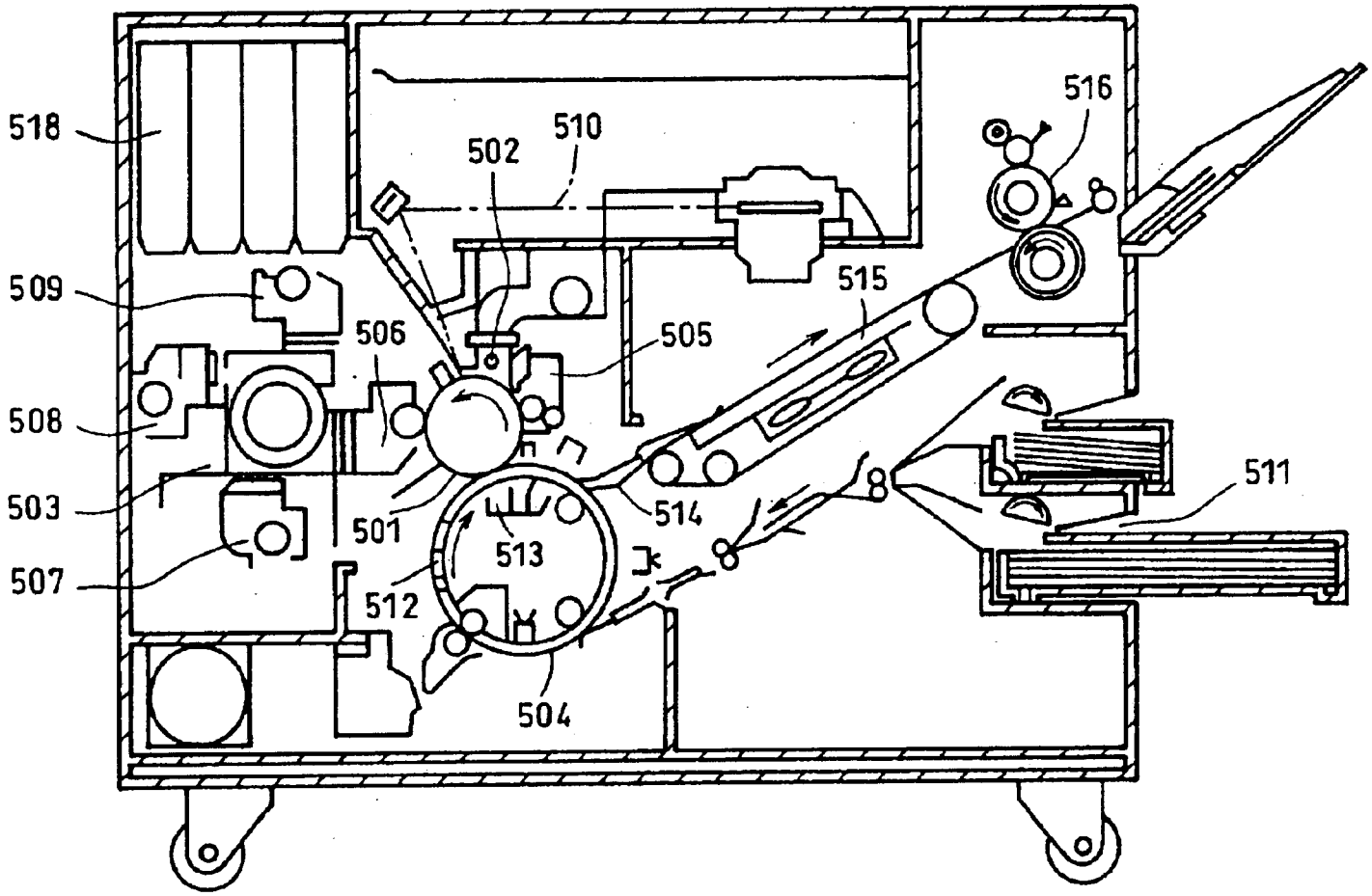
FIG. 3(PRIOR ART)
FIG. 3 is a view showing a structure of a conventional color electrophotographic apparatus.

FIG. 2 shows a structure of the intermediate transfer belt unit 202.

The intermediate transfer belt unit 202 includes, in a unit housing 202*a*, a transfer belt 203, a first transfer roller 204 composed of a conductive elastic body, a second transfer roller 205 composed of an aluminum roller, a tension roller 206 for adjusting tension of the transfer belt 203, a belt cleaning roller 207 for cleaning a toner image remaining on the transfer belt 203, a scraper 208 for scraping off toner recovered onto the cleaner roller 207, waste toner storage sections 209*a* and 209*b* for storing recovered toner, and a position detector 210 for detecting a position of the transfer belt 203. The intermediate transfer belt unit 202 can be attached to or detached from a predetermined accommodation section in the outer housing 201 by opening the printer front surface plate 201A as represented by a dotted line in FIG. 1.

The intermediate transfer belt 203 is obtained by kneading a conductive filler in insulating resin to form a film through an extruder. In the present example, 5 parts by weight of conductive carbon (e.g., Ketchen Black (Trade Name), produced by AKZO Co.) were added to 95 parts by weight of polycarbonate resin (e.g., Yupiron Z300 produced by Mitsubishi Gas Chemical Co., Inc.) as insulating resin to form a film. The resultant film was coated with fluorocarbon resin. The thickness of the film was about $350\times10^{-6}$ m and the resistance thereof was about $10^7$ to $10^8$ Ω·cm.

The intermediate transfer belt 203 is wound around the first transfer roller 204, the second transfer roller 205, and the tension roller 206, so as to be movable in an arrow direction. The first transfer roller 204, the second transfer roller 205, and the tension roller 206 are respectively made of an endless belt-shaped film (thickness: $100\times10^{-6}$ m) containing semiconductive urethane as its base member, and each outer periphery is made of urethane foam subjected to low resistance processing so as to have a resistance of $10^7$ Ω·cm. The peripheral length of the intermediate transfer belt 203 is set at 360 mm, which corresponds to a total of a longitudinal length (298 mm) of an A4 sheet (longest sheet size) and a length (62 mm) slightly longer than a half of a peripheral length of a photoreceptor (diameter: 30 mm) described later.

When the intermediate transfer belt unit 202 is attached to the printer, the first transfer roller 204 is pressed onto a photoreceptor 211 (shown in FIG. 2) by a force of about 1.0 kg through the intermediate transfer belt 203. The second transfer roller 205 is pressed onto a third transfer roller 212 (shown in FIG. 2) having the same structure as that of the first transfer roller 204 through the intermediate transfer belt 203. The third transfer roller 212 is designed so as to be rotated in accordance with the movement of the intermediate transfer belt 203.

The cleaning roller 207 is a roller in a belt cleaning section for cleaning the intermediate transfer belt 203. The cleaning roller 207 has a structure in which an A.C. voltage for electrostatically attracting toner is applied to a metallic roller. The cleaning roller 7 may be a rubber blade or a conductive fur brush with a voltage applied thereto.

Referring to FIG. 1 again, four sectors (i.e., image forming units 217Bk, 217C, 217M, and 217Y) for black, cyan, magenta, and yellow are arranged in a circular shape in the middle of the printer, to form an image forming unit group 218. Each image forming unit 217 can be attached to or detached from the image forming unit group 218 in a predetermined position by opening a printer upper surface plate 201C (shown in FIG. 1) around a hinge axis 201D. When the image forming unit 217 is correctly attached to the printer, a mechanical driving system and an electric circuit system of the image forming unit side are combined with those on the printer side through a mutual coupling member (not shown), whereby the image forming unit 217 is mechanically and electrically integrated with the printer.

The image forming units 217Bk, 217C, 217M, and 217Y disposed in a circular shape are supported by a supporter (not shown). The image forming units 217Bk, 217C, 217M, and 217Y are entirely driven by a mobile motor 219, and can be rotated around a cylindrical axis 220 which is fixed so as not to be rotated. Each image forming unit 217 can be successively positioned by rotation movement at an image forming position 221 opposed to the second transfer roller 204 which supports the intermediate transfer belt 203. The image forming position 221 is also a position for exposure to signal light 222.

Each image forming unit 217 is composed of the same structural member except for a developer therein. Therefore, for simplicity, the image forming unit 217Bk for black will be described, and the description of the other units will be omitted. For each color, the same portions are denoted by the same reference numerals. In the case where it is required to discriminate a structure of each color, letters representing each color are provided to reference numerals.

As a developer, a two-component developer was used. As carrier, Cu-Zn-$Fe_2O_3$ particles coated with silicone resin were used.

Referring to FIG. 1 again, reference numeral 235 denotes a laser beam scanner section provided on a lower side of the outer housing 201. The laser beam scanner section 235 includes a semiconductor laser, a scanner motor 235*a*, a polygon mirror 235*b*, a lens system 235*c*, and the like. The signal light 222 of an image laser corresponding to a time-series electrical pixel signal of image information from the laser beam scanner section 235 passes through a light path window 236 disposed between the image forming units 217Bk and 217Y in FIG. 1. Then, the signal light 222 passes through a window 237 which is a partial opening of an axis 220. The signal light 222 is incident upon a mirror 238 fixed in the axis 220 and reflected from the mirror 238. The signal light 222 enters the image forming unit 217Bk in a substantially horizontal direction through an exposure window 225 of the image forming unit 217Bk, which is positioned at the image forming position 221. The signal light 222 passes through a path between a toner hopper 226 and a cleaner 234 provided in an up-and-down direction in the image forming unit 217Bk. The signal light 222 is incident upon an exposure section on a left side of the photoreceptor 211 and exposed to light by scanning in a main line direction.

As the light path from the light path window 236 to the mirror 238, a gap between the adjacent image forming units 217Bk and 217Y is utilized. Therefore, there is almost no dead space in the image forming unit group 218. Furthermore, since the mirror 238 is provided in the middle of the image forming unit group 218, the mirror 238 can be composed of a single fixed mirror, which is simple and easily positioned.

Reference numeral 212 denotes a third transfer roller provided on an inner side of the printer front surface plate 201A and in an upper portion of a sheet supply roller 239. In a nip portion where the intermediate transfer belt 203 is pressed onto the third transfer roller 212, a sheet transportation path is formed so that sheets are transported from the sheet supply roller 239 provided in a lower portion of the printer front surface plate 201A.

Reference numeral 240 denotes a sheet supply cassette provided on a lower end side of the printer front surface plate 201A so as to project outward. A plurality of sheets S simultaneously can be set in the sheet supply cassette 240. Reference numerals 241*a* and 241*b* denote sheet transportation timing rollers; 242*a*.242*b* denote a fixing roller pair provided in an upper portion in the printer; 243 denotes a sheet guide plate provided between the third transfer roller 212 and the fixing roller pair 242*a*.242*b*; 244*a*.244*b* denote a sheet discharge roller pair provided on a sheet exit side of the fixing roller pair 242*a*.242*b*; 245 denotes a fixing oil storage for storing silicone oil 246 to be supplied to the fixing roller 242*a*; and 247 denotes an oil supply roller for coating the fixing roller 242*a* with the silicone oil 246.

A coating amount of silicone oil on the fixing roller is preferably 50 $\mu g/cm^2$ or less, more preferably 2 to 30 $\mu g/cm^2$. In the case where a coating amount exceeds 50 $\mu g/cm^2$, it becomes impossible to write something on a fixed image with a writing instrument.

As silicone oil used according to the present invention, dimethyl silicone oil, fluorosilicone oil, amino modified silicone oil, and the like are preferably used.

The main structure of the electrophographic apparatus according to the present invention has been described above.

In an electrophotographic apparatus using toner of the present example, a waste toner storage is provided in each image forming unit and the intermediate transfer belt unit. If the toner of the present invention is used, waste toner is hardly generated due to a high transfer efficiency, so that the size of the waste toner storage can be minimized.

First, the image forming unit group 218 is in a position shown in FIG. 1, and the image forming unit 217Bk for black is positioned at the image forming position 221 as shown in the figure. At this time, the photoreceptor 211 is in contact with the first transfer roller 204 via the intermediate transfer belt 203.

In the image forming step, signal light for black is input from the laser beam scanner section 235 to the image forming unit 217Bk, whereby an image is formed with black toner. At this time, an image forming speed (60 mm/s equal to a peripheral speed of the photoreceptor) of the image forming unit 217Bk is set so as to be equal to a moving speed of the intermediate transfer belt 203. At the same time as image forming, a black toner image is transferred to the intermediate transfer belt 203 by the function of the first transfer roller 204. At this time, a D.C. voltage of ±1 kV is applied to the first transfer roller. Immediately after a black toner image is completely transferred, the image forming units 217Bk, 217C, 217M, and 217Y (i.e., the image forming unit group 218) are entirely driven by the moving motor 219 to be rotated in the arrow direction in FIG. 1. When the image forming unit group 218 is rotated by 90°, and the image forming unit 217C reaches the image forming position 221, the image forming unit group 218 is stopped. During this time, the components of the image forming unit other than the photoreceptor, such as the toner hopper 226 and the cleaner 234, are positioned on an inner side of a rotation arc of an end of the photoreceptor 211. Therefore, the intermediate transfer belt 203 will not come into contact with the image forming unit.

After the image forming unit 217C reaches the image forming position 221, the laser beam scanner section 235 inputs signal light to the image forming unit 217C with a cyan signal in the same way as the above, whereby a toner image is formed and transferred. By this time, the intermediate transfer belt 203 makes a cycle, and write timing of signal light for cyan is controlled so that a cyan toner image is aligned with the previously transferred black toner image. During this time, the third transfer roller 212 and the cleaning roller 207 are slightly away from the intermediate transfer belt 203 so as not to disturb a toner image on the intermediate transfer belt 203.

The same operation as described above is performed for magenta and yellow, and a color image is formed on the intermediate transfer belt 203, in which toner images of four colors are overlapped with each other. After, the last yellow toner image is transferred, toner images of four colors are transferred at the same timing to a sheet transported from the sheet supply cassette 240 by the function of the third transfer roller 212. At this time, the second transfer roller 205 is grounded, and a D.C. voltage of 1.5 kV is applied to the third transfer roller 212. A toner image transferred to the sheet is fixed by the fixing roller pair 242*a*.242*b*. The sheet is output from the apparatus through the discharge roller pair 244*a*.244*b*. Toner remaining on the intermediate transfer belt 203 after transfer is cleaned by the cleaning roller 207 and becomes ready for formation of the subsequent image.

Next, an operation during a monochromatic mode will be described. During a monochromatic mode, an image forming unit for a predetermined color is moved to the image forming position 221. Then, an image of a predetermined color is formed and transferred to the intermediate transfer belt 203 in the same way as the above. Thereafter, continuously, the image on the intermediate transfer belt 203 is transferred to a sheet transported from the sheet supply cassette 240 by the third transfer roller 212 and fixed thereon as it is.

In the above-mentioned example, an image forming unit with a particular structure is used. However, even in the case of an image forming unit having another structure using a conventional developing method, the nature and functional effect of the present invention will not be changed.

Table 1 shows binder resin used in the above-mentioned example, and Table 2 shows a toner composition.

TABLE 1

| Characteristics of binder resin | MI (g/10 min) | Softening point (° C.) | Tg (° C.) | Mn | Mw | Peak | THF insoluble amount (Wt %) | G'at190° C. (Pa) |
|---|---|---|---|---|---|---|---|---|
| Polyester resin A | 32.5 | 106 | 59 | 3000 | 11000 | 8000 | 0.3 | 10 |
| Polyester resin B | 13.0 | 113 | 61 | 3000 | 31000 | 6000 | 0 | 38 |
| Polyester resin C | 3.8 | 129 | 63 | 3900 | 98000 | 8000 | 5.9 | 130 |

MI: Melt index (125° C., 2160 g)
Peak: Peak molecular weight in a molecular weight distribution

TABLE 2

| Toner composition | Toner composition a1 | Toner composition a2 |
|---|---|---|
| Binder resin | Resin A (100 parts by weight) | ← |
| Colorant | C.I.Pigment Red 57-1 (5 parts by weight) | ← |
| Wax | — | Hydrogenated jojoba oil (5 parts by weight) |
| Charge control agent | Zinc salicylate (1 part by weight) | ← |
| External additive | R-974: Nippon Aerosil K.K. (1.5 parts by weight) | ← |

The materials other than an external additive shown in Table 2 were previously mixed by a Henschel mixer FM-20B. Thereafter, the mixture was kneaded at a supply amount of 5 kg/hour, using a two-axis kneader PCM-30 whose axis temperature was set at 90° C. The resultant aggregates were roughly crushed by a cutter mill having a mesh of 2 mm, and finely crushed by a jet mill IDS-2.

The finely crushed powder thus obtained was classified by a multifractioned classification device utilizing a Coanda effect to obtain a toner base. The toner base was mixed with the external additive by the Henschel mixer to obtain a magenta toner a1. In Table 2, the added amount is represented by parts by weight. Furthermore, the added amount of an external additive is based on 100 parts by weight of the toner base.

Table 3 shows values of physical properties of toner, transparency or an OHP, and a hot offset starting temperature.

TABLE 3

| Toner | a1 | a2 | b1 | b2 | c1 | c2 | w1 | w2 | w3 | w4 |
|---|---|---|---|---|---|---|---|---|---|---|
| G"(T) at170° C. | 400 | 340 | 710 | 630 | 2000 | 1500 | 400 | 400 | 320 | 400 |
| G'(T) at190° C. | 25 | 25 | 400 | 350 | 200 | 200 | 25 | 25 | 1100 | 25 |
| 2~5 μm (% by number) | 25 | 30 | 18 | 20 | 34 | 35 | 3 | 25 | 23 | 25 |
| Compression ratio C (%) | 24 | 27 | 19 | 23 | 30 | 32 | 12 | 43 | 28 | 24 |
| $Log_{10}$(G'(T) /G'(R)) | 0.4 | 0.4 | 1.02 | 0.96 | 0.19 | 0.19 | 0.4 | 0.4 | 2.04 | 0.4 |
| Dv($X10^{-6}$m) | 8.1 | 8.1 | 9.3 | 9.3 | 7.5 | 7.5 | 8.7 | 8.1 | 8.4 | 8.1 |
| DcXTD/Dv | 0.37 | 0.37 | 0.32 | 0.32 | 0.4 | 0.4 | 0.34 | 0.37 | 0.36 | 0.15 |
| Transparency for an OHP (%) | 90 | 95 | 88 | 91 | 85 | 89 | 78 | 77 | 62 | 85 |
| Hot offset starting temperature (° C.) | 200 | 205 | 205 | 210 | 215 | 220 | 205 | 185 | 190 | 200 |
| Amount of charge (μC/g) | −23 | −21 | −25 | −22 | −26 | −24 | −29 | −7.5 | −6.9 | −39 |

Glossiness of an image and transparency for an OHP were both high, and hot offset did not occur until 190° C.

A copying test was conducted by using the toner thus obtained, and a coping image was evaluated.

In the case of using the toner a1, there were no irregularities of horizontal lines and scattering of toner in an initial copying image, whereby a mat image without any inconsistencies having a high image density of 1.4 or more was obtained. An amount of charge was high, and fogging did not occur in a non-image portion. Even in a 20 k-page continuous printing test, initial image quality was maintained, and toner-filming did not occur with respect to the photoreceptor.

Example 2

A magenta toner a2 was prepared in the same way as in Example1, using the materials other than an external additive shown in Table 2. Glossiness of an image, transparency for an OHP, and a hot offset starting temperature were high. Thus, a high quality image was obtained.

In an initial copying image, there were no irregularities of horizontal lines and scattering of toner, whereby a mat image with a high density of 1.4 or more was uniformly obtained. Fogging did not occur in a non-image portion. Even in a 20 k-page continuous printing test, initial image quality was maintained, and toner-filming did not occur with respect to the photoreceptor.

Example 3

Among the materials other than the external additive shown in Table 2, only the binder resin was replaced by polyester resins B and C shown in Table 1, whereby magenta toners b1, b2, c1, and c2 were prepared in the same way as in Example 1. The prepared toners had high glossiness of an image, high transparency for an OHP, and a high hot offset starting temperature. Thus, a high quality image was obtained.

Example 4

An exemplary electrophotographic apparatus for electrophotography using toner of the present example further performs a waste toner recycling step of returning waste toner to the developing step and recycling it, in addition to the steps performed by the apparatus shown in FIG. 1. More specifically, the apparatus used in the present example further includes a mechanism of transporting waste toner from the cleaner 234 to the toner hopper 226 shown in FIG. 1. In the present example, although a two-component developer is used, the present invention is not limited thereto. One-component developer may also be used.

A copying test was conducted by using the magenta toners a1, a2, b1, b2, c1, and c2, and copying images were evaluated.

In any of these toners, image quality, image glossiness, and transparency for an OHP were not changed due to recycling of waste toner. Furthermore, even in a 20 k-page continuous printing test, toner-filming did not occur with respect to a photoreceptor, and initial image quality was obtained.

Example 5

The colorant among the materials shown in Table 2 was replaced by C.I. Pigment Yellow 17, and C.I. Pigment Blue 15-3, and a yellow toner and a blue toner were prepared in the same way as in Example 1. Hot offset did not occur until 200° C. Even in a full color image, glossiness and transparency for an OHP were high. Thus, a high quality image with a satisfactory mixing property, outstanding color reproducibility, and high resolution was obtained.

Comparative Example 1

Using the materials other than the external additive shown in Table 2, the same steps as those in Example 1 were conducted up to the fine crushing step. Thereafter, a classification step was conducted three times to prepare a magenta toner w1. Since there were 3% by number of toner particles with a size of $2\times10^{-6}$ to $5\times10^{-6}$ m, transparency for an OHP was decreased. Furthermore, as printing proceeded, image density was decreased.

Comparative Example 2

Using the materials other than the external additive shown in Table 2, the same steps as those in Example 1 were conducted. Thereafter, a magenta toner w2 was prepared using 0.2 parts by weight of an external additive. With a decrease in transparency for an OHP, a hot offset starting temperature was also decreased. Furthermore, an amount of charge was small, and a poor image with a number of inconsistencies was obtained from the start.

Comparative Example 3

A magenta toner w3 was prepared in the same way as in Example 1, except that the materials other than the external additive shown in Table 2 were used, and a kneading temperature was set at 200° C. in the kneading step. The colorant was not satisfactorily dispersed, and glossiness was poor. With a decrease in transparency for an OHP, a hot offset starting temperature was also decreased. Furthermore, an amount of charge was small, and the image with a number of inconsistencies was obtained from the start.

Comparative Example 4

A magenta toner w4 was prepared in the same way as in Example 1, using the materials other than the external additive shown in Table 2. This toner was the same as the magenta toner a1. However, a mixed ratio (toner concentration) between the toner and the carrier was set at 2.0% during printing. Image density was low from the start, and an image had a number of inconsistencies while printing proceeded. Transparency for an OHP was decreased, and black points were generated.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electrophotographic method comprising:

making visible an electrostatic latent image on a photoreceptor by developing it with two-component developer comprising a toner formed of a binder resin, a colorant and an external additive; and a carrier, wherein a loss modulus G"t (frequency: 10 rad/s) of the toner at 170° C. satisfies $100\leqq G''t\leqq5000$ (Pa), a storage modulus G't (frequency: 10 rad/s) of the toner at 190° C. satisfies $10\leqq G't\leqq3000$ (Pa), and the toner contains 5 to 50% by number of toner particles with a size of $2\times10^{-6}$ to $5\times10^{-6}$ m in size distribution of the toner;

wherein a relationship DC×TD/Dv of a volume average size Dc(m) of the carrier, a volume average size Dv(m) of the toner, and a mixed ratio of the toner concentration between the toner and carrier TD is a value 0.20 to 0.45, transferring the visible toner on the photoreceptor to a transfer sheet;

cleaning the photoreceptor by removing the toner, which has partially remained on the photoreceptor during the transfer, from the photoreceptor; and returning waste toner removed by the cleaning and re-cycling it.

2. An electrophotographic method according to claim 1, wherein a compression ratio C calculated from a static density of the toner and a dynamic density thereof satisfies $5\leqq C(\%)\leqq40$.

3. An electrophotographic method according to claim 1, wherein the toner further includes wax.

4. An electrophotographic method comprising:

making visible an electrostatic latent image on a photoreceptor by developing it with two-component developer comprising, a toner formed of a binder resin, a colorant and an external additive; and a carroer, wherein a loss modulus G"t (frequency: 10 rad/s) of the toner at 170° C. satisfies $100\leqq G''t\leqq5000$ (Pa), a storage modulus G't (frequency: 10 rad/s) of the toner at 190° C. satisfies $10\leqq G't\leqq3000$ (Pa), and a compression ratio C calculated from a static density of the toner and a dynamic density thereof satisfies $5\leqq C(\%)\leqq40$;

wherein a relationship DC×TD/Dv of a volume average size Dc(m) of the carrier, a volume average size Dv(m) of the toner, and a mixed ratio of the toner concentration between the toner and carrier TD is a vale 0.20 to 0.45, transferring the visible toner on the photoreceptor to a transfer sheet;

cleaning the photoreceptor by removing the toner, which has partially remained on the photoreceptor during the transfer, from the photoreceptor; and returning waste toner removed by the cleaning and re-cycling it.

5. An electrophotographic method comprising:

making visible an electrostatic latent image on a photoreceptor by developing it with two-component developer comprising a toner formed of a binder resin, wax, a colorant and an external additive; and a carrier, wherein a loss modulus G"t (frequency: 10 rad/s) of the toner at 170° C. satisfies $100 \leqq G''t \leqq 5000$ (Pa), and a storage modulus G't (frequency: 10 rad/s) of the toner at 190° C. satisfies $10 \leqq G't \leqq 3000$ (Pa);

wherein a relationship Dc×TD/Dv of a volume average size Dc(m) of the carrier, a volume average size Dv(m) of the toner, and a mixed ratio of the toner concentration between the toner and carier TD is a value 0.20 to 0.45, transferring the visible toner on the photoreceptor to a transfer sheet;

cleaning the photoreceptor by removing the toner, which has partially remained on the photoreceptor during the transfer, from the photoreceptor; and returning waste toner removed by the cleaning and re-cycling it.

6. An electrophotographic method according to claim 5, wherein a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}(G't/G'r) \leqq 2$.

7. An electrophotographic method according to claim 6, wherein a compression ratio C calculated from a static density of the toner and a dynamic density thereof satisfies $5 \leqq C(\%) \leqq 40$.

8. An electrophotographic method comprising:

making visible an electrostatic latent image formed on an image holder by developing it with two-compnent developer comprising a toner formed of a binder resin, a colorant and an external additive; and a carrier wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and the toner contains 5 to 50% by number of toner particles with a size of $2\times10^{-6}$ to $5\times10^{-6}$ m in size distribution of the toner;

wherein a relationship Dc×TD/Dv of a volume average size Dc(m) of the carrier, a volume average size Dv(m) of the toner, and a mixed ratio of the toner concentration between the toner and carrier TD is a value 0.20 to 0.45, primary-transferring the toner to an endless intermediate transfer body, which is in contact with the image holder;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

9. An electrophotographic method according to claim 8, wherein a compression ratio C calculated from a static density of the toner and a dynamic density thereof satisfies $5 \leqq C(\%) \leqq 40$.

10. An electrophotographic method according to claim 8, wherein the toner further includes wax.

11. An electrophotographic method comprising:

making visible an electrostatic latent image formed on an image holder by developing it with two-component developer comprising a toner formed of a binder resin, a colorant and an external additive; and a carrier, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa), and a compression ratio C calculated from a static density of the toner and a dynamic density thereof satisfies $5 \leqq C(\%) \leqq 40$;

wherein a relationship Dc×TD/Dv of a volume average size Dc(m) of the carrier, a volume average size Dv(m) of the toner, and a mixed ratio of the toner concentration between the toner and carrier TD is a value 0.20 to 0.45, primary-transferring the toner to an endless intermediate transfer body, which is in contact with the image holder;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

12. An electrophotographic method comprising:

making visible an electrostatic latent image formed on an image holder by developing it with two-component developer comprising a toner formed of a binder resin, a colorant and an external additive; and a carrier, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies $10 \leqq G't \leqq 3000$ (Pa);

wherein a relationship Dc×TD/Dv of a volume average size Dc(m) of the carrier, a volume average size Dv(m) of the toner, and a mixed ratio of the toner concentration between the toner and carrier TD is a value 0.20 to 0.45, primary-transferring the toner to an endless intermediate transfer body, which is in contact with the image holder;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

13. An electrophotographic method according to claim 12, wherein a storage modulus G'r (frequency: 10 rad/s) of the binder resin at 190° C. and a storage modulus G't (frequency: 10 rad/s) of the toner at 190° C. satisfies $0.15 \leqq \mathrm{Log}_{10}(G't/G'r) \leqq 2$.

14. An electrophotographic method according to claim 13, wherein a compression ratio C calculated from a static density of the toner and a dynamic density thereof satisfies $5 \leqq C(\%) \leqq 40$.

15. An electrophotographic method comprising:

making visible an electrostatic latent image formed on an image holder by developing it with two-component developer comprising a toner formed of a binder resin, a colorant and an external additive; and a carrier, wherein a loss modulus G"t (frequency: 10 rad/s) of the toner at 170° C. satisfies $100 \leqq G''t \leqq 5000$ (Pa), a storage modulus G't (frequency: 10 rad/s) of the toner at 190° C. satisfies 10≦G't ≦3000 (Pa), and the toner contains 5 to 50% by number of toner particles with a size of $2\times10^{-6}$ to $5\times10^{-6}$ m in size distribution of the toner;

wherein a relationship Dc×TD/Dv of a volume average size Dc(m) of the carrier, a volume average size Dv(m) of the toner concentration between the toner and carrier TD is a value 0.20 to 0.45, primary-transferring the toner to an endless intermediate transfer body, which is in contact with the image holder;

cleaning the photoreceptor by removing the toner, which has partially remained on the photoreceptor during the primary-transfer, from the photoreceptor;

returning waste toner removed by the cleaning to development and recycling it;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

16. An electrophotographic method according to claim 15, wherein a compression ratio C calculated from a static density of the toner and a dynamic density thereof satisfies 5≦C(%)≦40.

17. An electrophotographic method according to claim 15, wherein the toner further includes wax.

18. An electrophotographic method comprising:

making visible an electrostatic latent image formed on an image holder by developing it with two-component developer comprising a toner formed of a binder resin, a colorant and an external additive; and a carrier, wherein a loss modulus G"t (frequency: 10 rad/s) of the toner at 170° C. satisfies 100≦G"t ≦5000 (Pa), a storage modulus G't (frequency: 10 rad/s) of the toner at 190° C. satisfies 10≦G't ≦3000 (Pa), and a compression ratio C calculated from a static density of the toner and a dynamic density thereof satisfies 5≦C(%) ≦40;

wherein a relationship Dc×TD/Dv of a volume average size Dc(m) of the carrier, a volume average size Dv(m) of the toner, and a mixed ratio of the toner concentration between the toner and carrier TD is a value 0.20 to 0.45, primary-transferring the toner to an endless intermediate transfer body, which is in contact with the image holder;

cleaning the photoreceptor by removing the toner, which has partially remained on the photoreceptor during the primary-transfer, from the photoreceptor;

returning waste toner removed by the cleaning to development and recycling it;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

19. An electrophotographic method comprising:

making visible an electrostatic latent image formed on an image holder by developing it with two-component developer comprising a toner formed of a binder resin, wax, a colorant and an external additive; and a carrier, wherein a loss modulus G"t (frequency: 10 rad/s) of the toner at 170° C. satisfies 100≦G"t ≦5000 (Pa), a storage modulus G't (frequency: 10 rad/s) of the toner at 190° C. satisfies 10≦G't ≦3000 (Pa);

wherein a relationship Dc×TD/Dv of a volume average size Dc(m) of the carrier, a volume average size Dv(m) of the toner, and a mixed ratio of the toner concentration between the toner and carrier TD is a value 0.20 to 0.45, primary-transferring the toner to an endless intermediate transfer body, which is in contact with the image holder;

cleaning the photoreceptor by removing the toner, which has partially remained on the photoreceptor during the primary-transfer, from the photoreceptor;

returning waste toner removed by the cleaning to development and recycling it;

forming an overlapped image of the transferred toner by performing the primary-transfer a plurality of times; and secondary-transferring the overlapped image of the transferred toner, which has been formed on the intermediate transfer body, collectively to an image receiving sheet transported from a sheet supply side.

20. An electrophotographic method according to claim 19, wherein a storage modulus G'r (frequency: 10 rad/s) of the binder resin at 190° C. and a storage modulus G't (frequency: 10 rad/s) of the toner at 190° C. satisfies $0.15\mathrm{Log}_{10}$ (G't/G'r)≦2.

21. An electrophotographic method according to claim 20, wherein a compression ratio C calculated from a static density of the toner and a dynamic density thereof satisfies 5≦C(%)≦40.

* * * * *

UNITED STATES PATENT AND TRADEMARK OFFICE

CERTIFICATE OF CORRECTION

PATENT NO. : 6,733,945 B2
DATED : May 11, 2004
INVENTOR(S) : Hirota et al.

It is certified that error appears in the above-identified patent and that said Letters Patent is hereby corrected as shown below:

Title page,
Item [56], References Cited, FOREIGN PATENT DOCUMENTS,
"JP 9-304956 11/1997" should read -- JP 304965 11/1997 --

Column 10,
Line 56, "216 g at 125° C." should read -- 2160 g at 125° C. --

Column 28,
Lines 28 and 58, "DC×TD/Dv" should read -- Dc×TD/Dv --
Line 50, "and a carroer," should read -- and a carrier, --
Line 61, "is a vale 0.20 to" should read -- is a value 0.20 to --

Column 29,
Line 38, "and a carrier" should read -- and a carrier, --

Column 32,
Line 46, "$0.15Log_{10}$" should read -- $0.15 \leq Log_{10}$ --

Signed and Sealed this

Thirtieth Day of November, 2004

JON W. DUDAS
*Director of the United States Patent and Trademark Office*